US007456678B2

(12) United States Patent
Passerini et al.

(10) Patent No.: US 7,456,678 B2
(45) Date of Patent: Nov. 25, 2008

(54) APPARATUS AND METHOD FOR PROVIDING A TEMPERATURE COMPENSATED REFERENCE CURRENT

(75) Inventors: Marco Passerini, Lozza (IT); Stefano Sivero, Capriate (IT); Mirella Marsella, Pandino (IT); Maria Mostola, Cavenago di Brianza (IT)

(73) Assignee: Atmel Corporation, San Jose, CA (US)

( * ) Notice: Subject to any disclaimer, the term of this patent is extended or adjusted under 35 U.S.C. 154(b) by 1 day.

(21) Appl. No.: 11/548,113

(22) Filed: Oct. 10, 2006

(65) Prior Publication Data

US 2008/0084240 A1 Apr. 10, 2008

(51) Int. Cl.
*G05F 1/10* (2006.01)

(52) U.S. Cl. ..... 327/538; 327/540; 327/541; 327/513

(58) Field of Classification Search ..... None
See application file for complete search history.

(56) References Cited

U.S. PATENT DOCUMENTS

| | | | | |
|---|---|---|---|---|
| 5,604,427 | A * | 2/1997 | Kimura | 323/313 |
| 6,037,833 | A * | 3/2000 | Ang | 327/543 |
| 6,052,020 | A * | 4/2000 | Doyle | 327/539 |
| 6,438,051 | B1 | 8/2002 | Fifield et al. | 365/207 |
| 6,518,833 | B2 | 2/2003 | Narendra et al. | 327/541 |
| 6,560,152 | B1 | 5/2003 | Cernea | 365/211 |
| 6,563,371 | B2 * | 5/2003 | Buckley et al. | 327/539 |
| 6,762,474 | B1 | 7/2004 | Mills, Jr. | 257/469 |
| 6,774,666 | B1 | 8/2004 | Samad | 326/32 |
| 6,809,575 | B2 | 10/2004 | Oddone et al. | 327/539 |
| 6,828,834 | B2 | 12/2004 | Sivero et al. | 327/143 |
| 6,870,418 | B1 | 3/2005 | Tang et al. | 327/513 |
| 6,934,209 | B2 | 8/2005 | Marr | 365/211 |
| 7,075,360 | B1 | 7/2006 | Holloway et al. | 327/543 |
| 7,119,528 | B1 * | 10/2006 | Rasmus | 323/317 |
| 2006/0038609 | A1 | 2/2006 | Oddone et al. | 327/539 |
| 2006/0066386 | A1 | 3/2006 | Hong | 327/513 |

FOREIGN PATENT DOCUMENTS

| | | | |
|---|---|---|---|
| JP | 57150187 | A2 | 9/1982 |
| WO | 2006/075202 | A1 | 7/2006 |

OTHER PUBLICATIONS

Vittoz et al. "CMOS Analog Integrated Circuits Based on Weak Inversion Operation." IEEE Journal of Solid-State Circuits, vol. SC-12, No. 3, Jun. 1977.

Lee et al. "Low Voltage, High Speed Circuit Designs for Gigabit DRAM's." IEEE Journal of Solid-State Circuits, vol. 32, No. 5, May 1997.

Sedra et al. Microelectronic Circuits. Oxford University Press IV edition 1998, pp. 139, 226.

B. Razavi. "Design of Analog CMOS Integrated Circuits." McGraw-Hill 2001, p. 379.

* cited by examiner

*Primary Examiner*—An T Luu
(74) *Attorney, Agent, or Firm*—Schwegman, Lundberg & Woessner P.A.

(57) ABSTRACT

An apparatus and method for providing a temperature compensated reference current in an electronic device is disclosed. The temperature compensated reference current is compensated for temperature and other circuit variations. The reference current is provided by an improved reference current generator and may be used in a memory device or any other desired circuit.

24 Claims, 8 Drawing Sheets

APPARATUS AND METHOD FOR PROVIDING A TEMPERATURE COMPENSATED REFERENCE CURRENT

FIELD OF INVENTION

The present invention relates to an apparatus and method for providing a temperature compensated reference current in electronic devices. The electronic device may be a memory device or any electronic circuit that desires the generation of a constant reference current that is compensated for temperature and other circuit fabrication variations.

BACKGROUND

FIG. 1A illustrates an example of a conventional reference current generator circuit 100. Generator circuit 100 comprises p-type metal-oxide semiconductor (PMOS) transistor 102, PMOS transistor 106, Operational amplifier (OP-AMP) 110, resistors $R_1$ 112, $R_2$ 114, $R_3$ 116, PNP bipolar junction transistor (BJT) 118, and PNP BJT 120. Current $I_{ref}$ is a desired reference current on node 108 generated by circuit 100 based on the values of resistors $R_1$ 112, $R_2$ 114, and $R_3$ 116 and the gain of OP-AMP 110.

Current $I_1$ on node 104 is proportional to the absolute temperature (PTAT) of the operating environment for circuit 100. Current $I_1$ is given by Equation (1) as follows:

$$I_1(T) = 2\frac{k_b T}{q} \cdot \frac{\ln(M)}{R}. \qquad \text{Equation (1)}$$

In Equation (1), $k_b$ is Boltzmann's constant $1.381\times10^{-23}$ Joules per Kelvins (K), T is the absolute temperature in Kelvins, q is the constant electron charge of $1.602\times10^{-19}$ Coulombs, M is a variable multiplier characteristics of BJT 120 with respect to the size of BJT 118, and R is the resistance value of resistors $R_1$ 112, $R_2$ 114, and $R_3$ 116. Purely as an example, variable T may be an operating temperature of circuit 100 such as −40° Celsius to 125° Celsius. Current $I_1$ may vary up to 50% in circuit 100 which can cause an inconsistent reference current level $I_{ref}$ at node 108.

FIG. 1B illustrates an example of a conventional reference current generator circuit 101 for compensating for the temperature dependence of current $I_1$. In circuit 101, n-type metal-oxide semiconductor (NMOS) transistor 124 provides a compensation current $I_{comp}$ to negate the temperature dependence effects of current $I_1$ at node 105 on the reference current $I_{ref}$. NMOS transistor 124 may be biased in weak-inversion mode with current $I_{comp}$ given by Equation (2) as follows:

$$I_{comp}(T) = I_s(T) \cdot e^{q\frac{(V_g - V_{th})}{nk_bT}} \left(e^{\frac{-qV_s}{k_bT}} - e^{\frac{-qV_d}{k_bT}}\right). \qquad \text{Equation (2)}$$

In Equation (2), $V_g$, $V_s$, and $V_d$ are the gate-to-bulk, the source-to-bulk, and the drain-to-bulk voltages of transistor 124, respectively. Variable n is a non-ideality factor dependent on the material used to fabricate NMOS transistor 124 and $V_{th}$ is the threshold voltage. $V_g$ is the gate-to-bulk voltage at node 126. The remaining parameters are defined as stated above. Current $I_s(T)$ is the saturation current given by Equation (3) as follows:

$$I_s(T) = \frac{AqD}{NW} BT^3 e^{-\frac{E_{gap}}{k_bT}}. \qquad \text{Equation (3)}$$

In Equation (3), A is the area of the device gate, D is the carrier diffusivity, N is the doping concentration, W is the channel width, B is a material dependent parameter, typically $5.4\times10^{31}$ $K^{-3}$ $cm^6$ for silicon, and $E_{gap}$ is the energy gap, typically 1.12 eV for silicon, for NMOS transistor 124. The remaining parameters are defined as stated above. Assuming $V_s$=0 and $V_d$>>$k_bT/q$, the compensation current provided by transistor 124 is given by Equation (4) as follows:

$$I_{comp}(T) \cong \frac{AqD}{NW} BT^3 e^{q\frac{\left(V_g - V_{th} - \frac{E_{gap}}{q}\right)}{nk_bT}}. \qquad \text{Equation (4)}$$

The parameters in Equation (4) are defined as stated above.

Since $I_1$ at node 105 is linearly dependent function of the absolute temperature level T and $I_{comp}$ has an exponential function of T, a constant reference current $I_{ref}$ at node 108 cannot be generated by circuit 101 when adding $I_1$ to $I_{comp}$. FIG. 1C shows the variability of reference current $I_{ref}$ at node 108 versus temperature in Celsius. At low temperatures, the exponential behavior of $I_{comp}$ dominates the behavior of $I_{ref}$ while at high temperatures the linear behavior of $I_1$ dominates the behavior of the reference current.

FIG. 1D illustrates an example of a conventional reference current generator circuit 103 for compensating for the temperature dependence of current $I_1$. The operation of circuit 103 is similar to that of circuit 101 except for the addition of resistor $R_F$ 128, which provides the compensation current given by Equation (5) as follows:

$$I_{comp}(T) \cong \frac{AqD}{NW} BT^3 e^{q\frac{\left(V_g - V_{th} - \frac{E_{gap}}{q}\right)}{nk_bT}} \cdot e^{-q\frac{R_F I_{comp}(T)}{k_bT}}. \qquad \text{Equation (5)}$$

The parameters in Equation (5) are defined as stated above.

Resistor $R_F$ 128 and circuit 103 may provide better reference current consistency than circuit 101 by constraining variations of $I_{ref}$ up to 3% as illustrated in FIG. 1E. Smaller variations of $I_{ref}$ over the operating temperature range are difficult to obtain because of the intrinsic difference in the behavior of $I_1$ and $I_{comp}$ with respect to the temperature variation. However, greater variations of $I_{ref}$ may exist if a larger operating temperature range for circuit 103 is desired. Moreover, transistor 124 is undesirably biased in weak-inversion mode, which is a mode difficult to achieve if the processing technology only comprises low-threshold transistors. If moderate inversion mode is used instead, the compensation current becomes dependent upon the threshold voltage of transistor 124 which is a process varying parameter. Therefore, a reference current that is more independent of temperature, circuit fabrication process variations, circuit material variations, and supply voltages is desirable.

SUMMARY

An apparatus and method for providing a temperature compensated reference current in an electronic device is disclosed. The temperature compensated reference current is compensated for temperature and other circuit variations. The reference current is provided by an improved reference current generator and may be used in a memory device or any other desired circuit.

BRIEF DESCRIPTION OF THE DRAWINGS

A more detailed understanding of the invention may be had from the following description, given by way of example and to be understood in conjunction with the accompanying drawings wherein.

DETAILED DESCRIPTION OF THE PREFERRED EMBODIMENTS

Figure 1A:
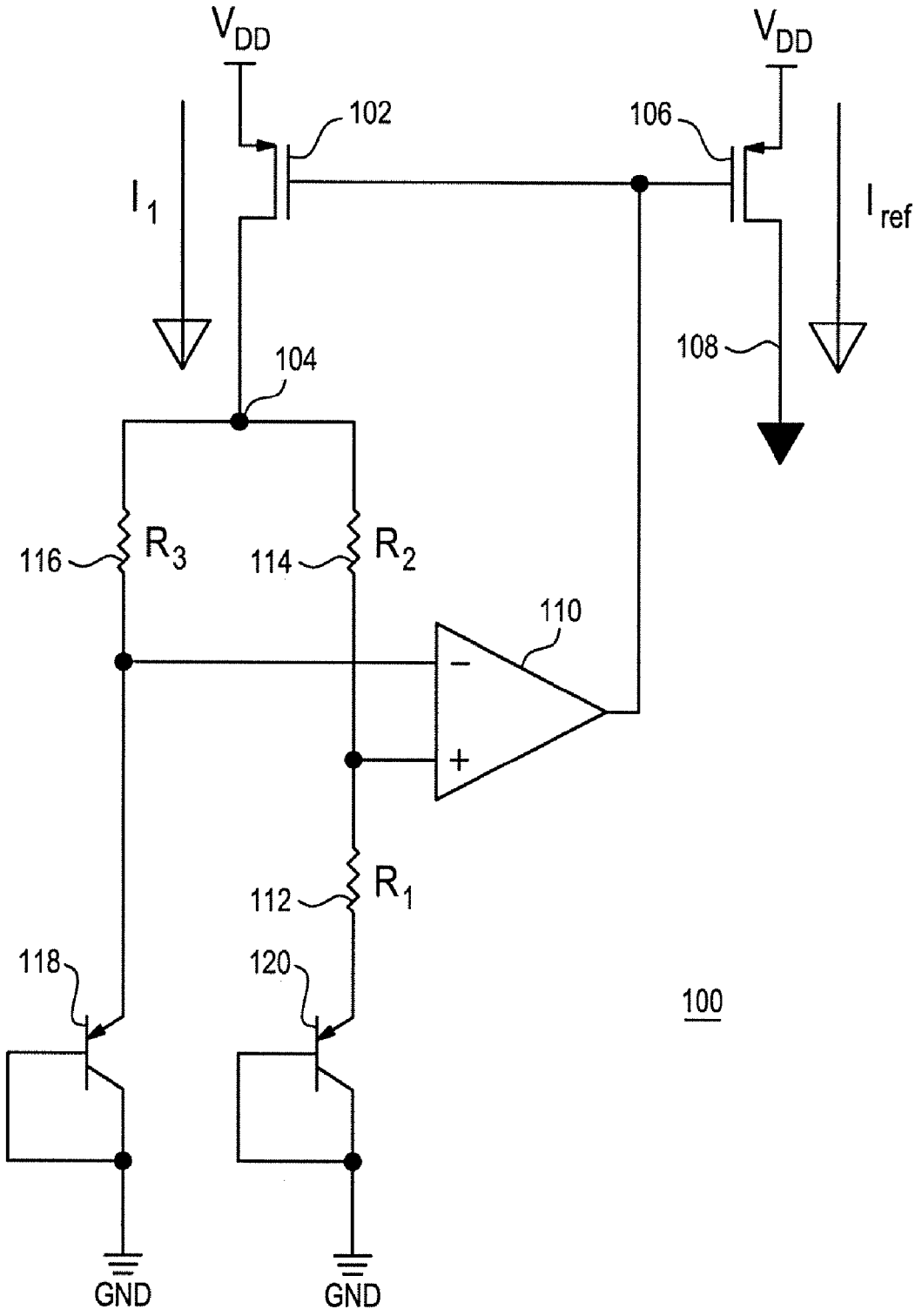
FIG. 1A (PRIOR ART)
FIG. 1A is an example of a conventional reference current generator circuit.
Figure 1B:
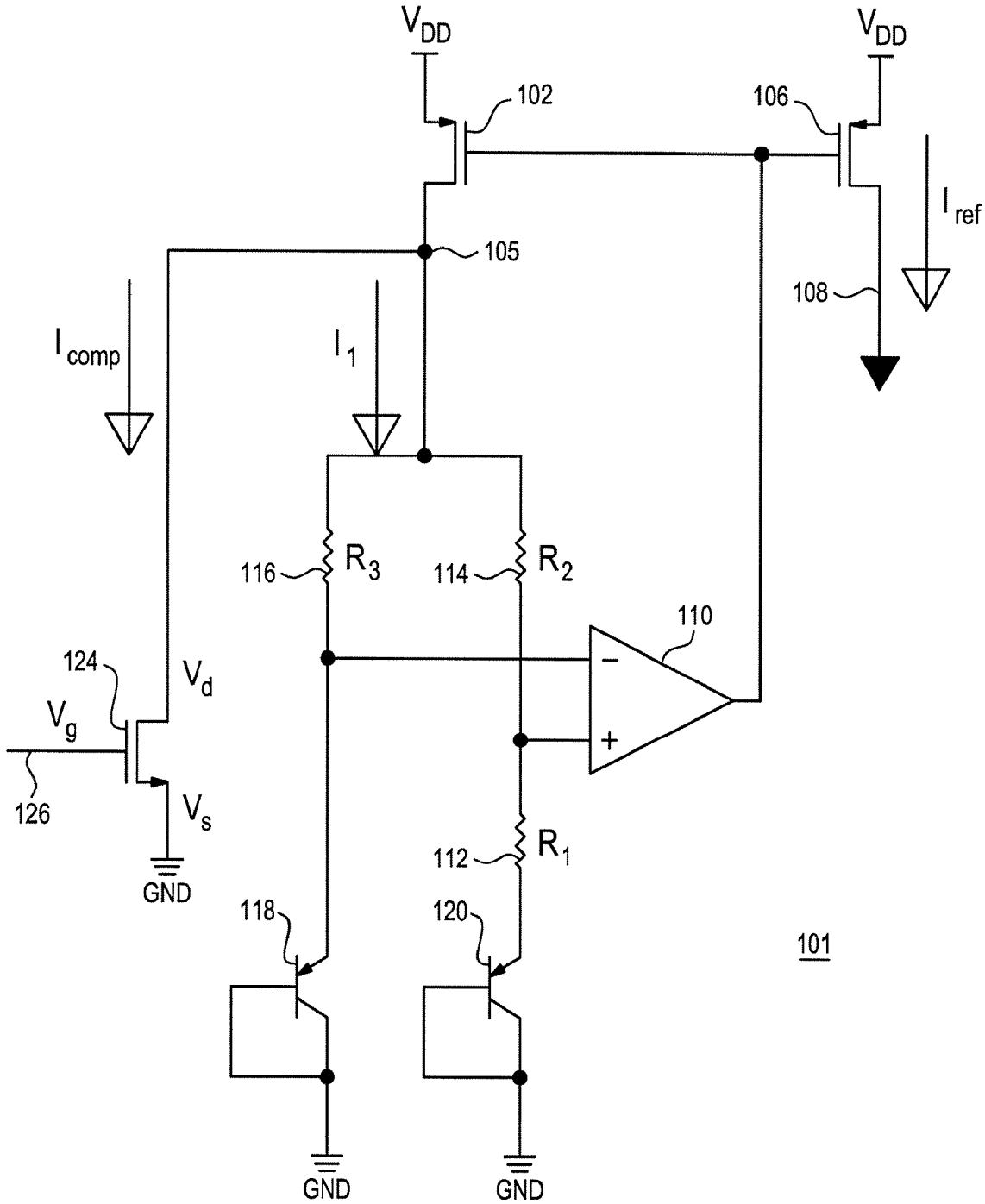
FIG. 1B (PRIOR ART)
FIG. 1B is an example of a conventional reference current generator circuit having compensation for the temperature dependence of a reference current.
Figure 1C:
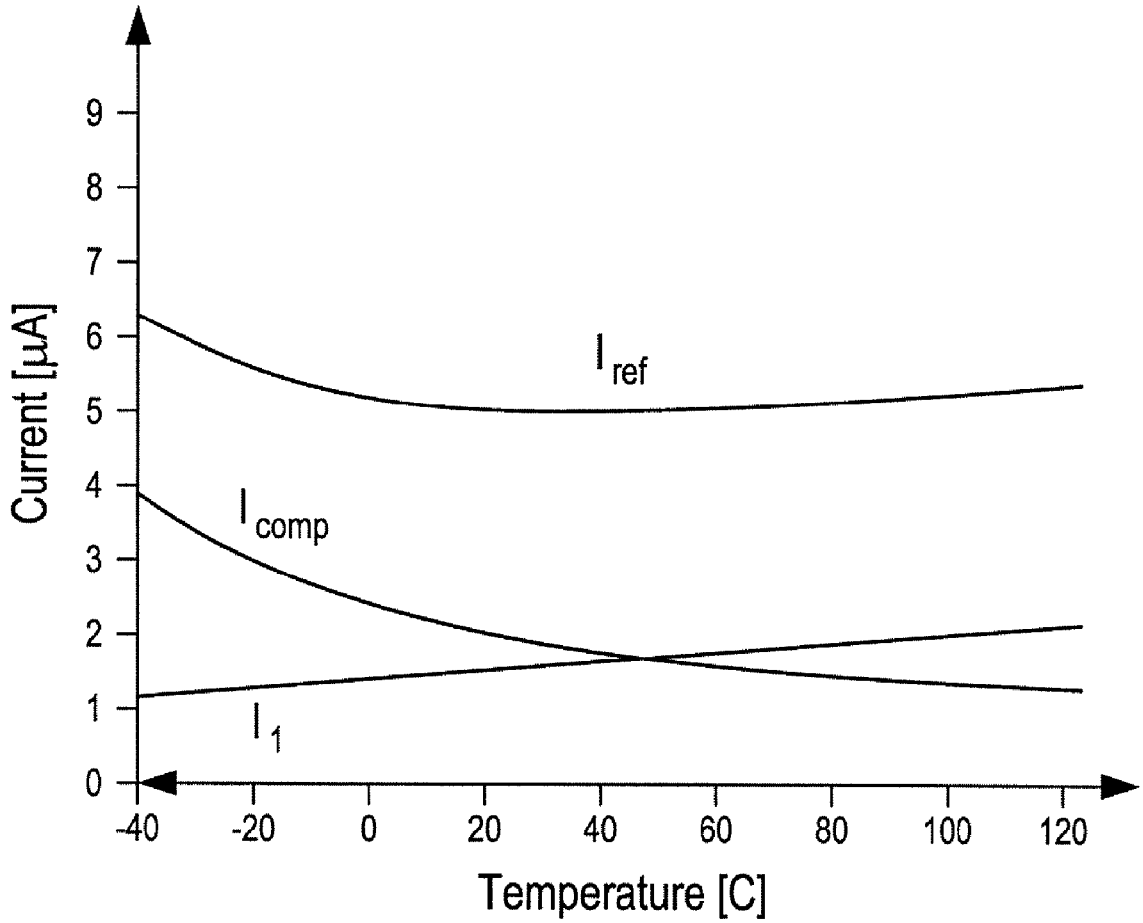
FIG. 1C (PRIOR ART)
FIG. 1C is an illustration of a temperature compensated reference current provided by a conventional reference current generator.
Figure 1D:
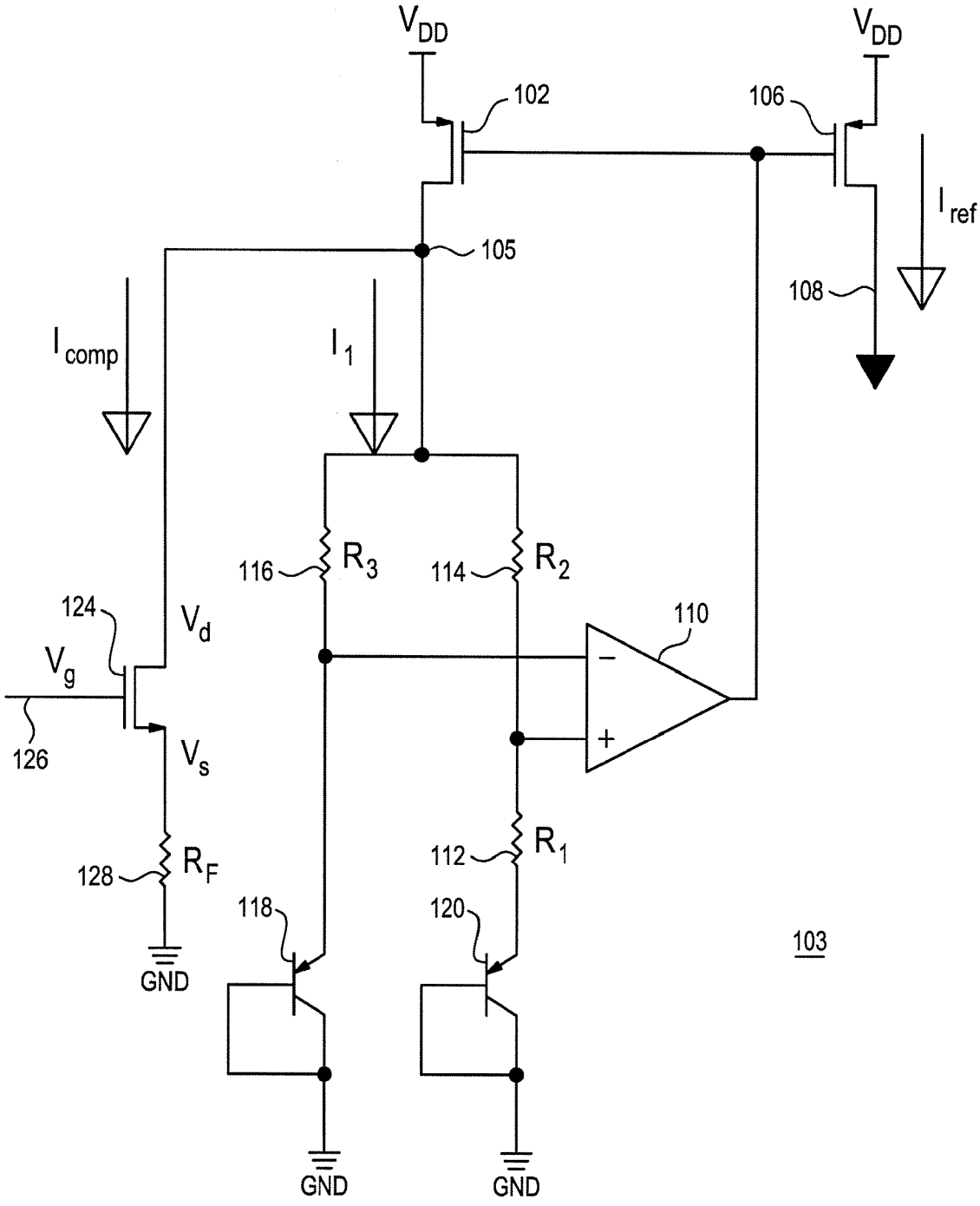
FIG. 1D (PRIOR ART)
FIG. 1D is an example of a conventional reference current generator circuit having compensation for the temperature dependence of a reference current.
Figure 1E:
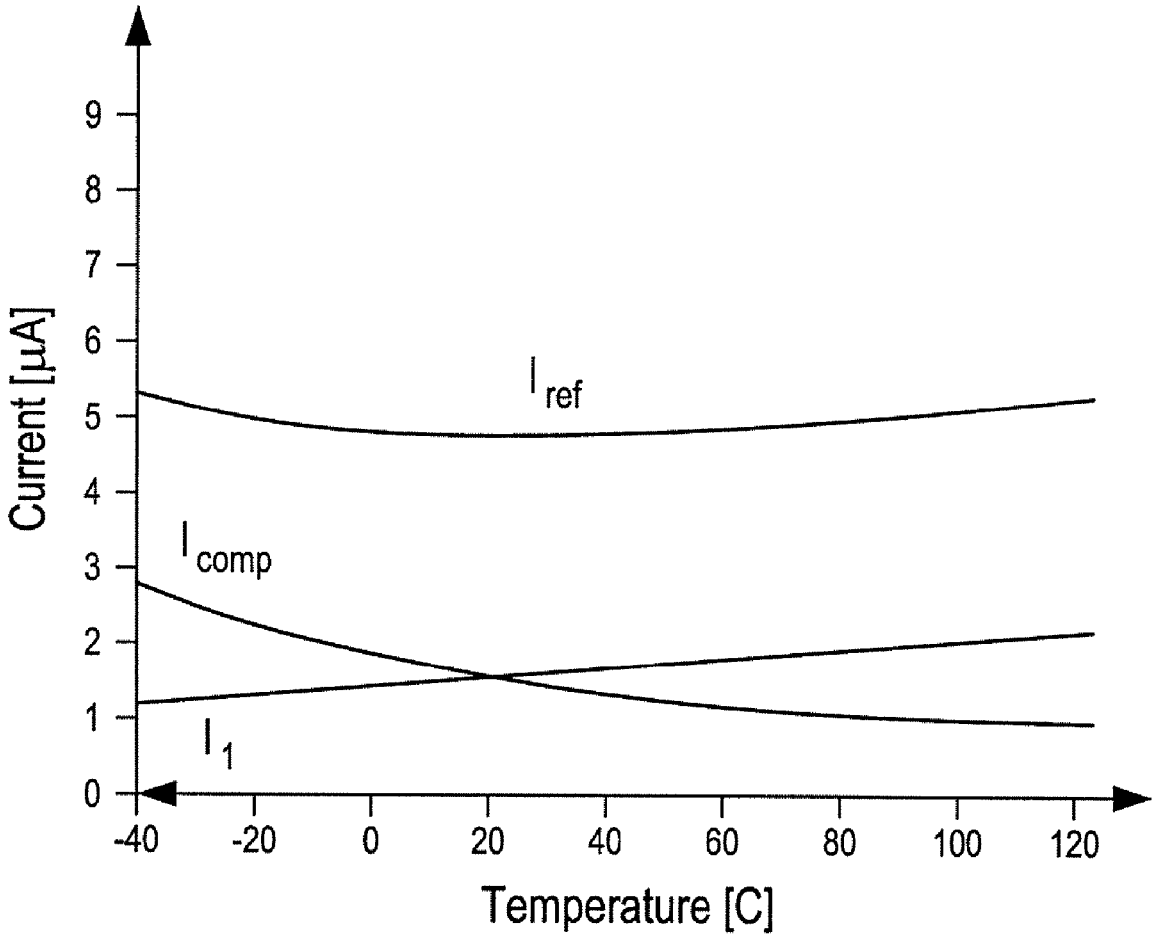
FIG. 1E (PRIOR ART)
FIG. 1E is an illustration of a temperature compensated reference current provided by a conventional reference current generator.

The present invention will be described with reference to the drawing figures wherein like numerals represent like elements throughout. For purposes of describing the present invention, the phrase low, medium, or high voltage levels may be used. It will be appreciated that the words "low", "medium", and "high" are relative terms and not necessarily a fixed voltage. Accordingly, the phrase low, medium, and/or high voltage level may be any voltage and may vary, for example, based on the processing technology and/or the material in which an electronic device is implemented.

As used herein, the word "level" may represent a fixed voltage or a voltage range, as desired. A node and a voltage at a node may be used interchangeably. Substantially may mean slightly less than, equal to, or slightly more than a numerical value.

The present invention may be used in any electronic device desiring a robust, temperature compensated reference current. In particular, a memory device may need a constant reference current for proper operation in operating environments having various wide temperature ranges. Examples of memory devices include parallel or serial Electrically Erasable Programmable Read-Only Memories (EEPROMs), Flash memories, serial Flash memories, and stacked Flash and Random Access Memory (RAM) modules.

Figure 2:
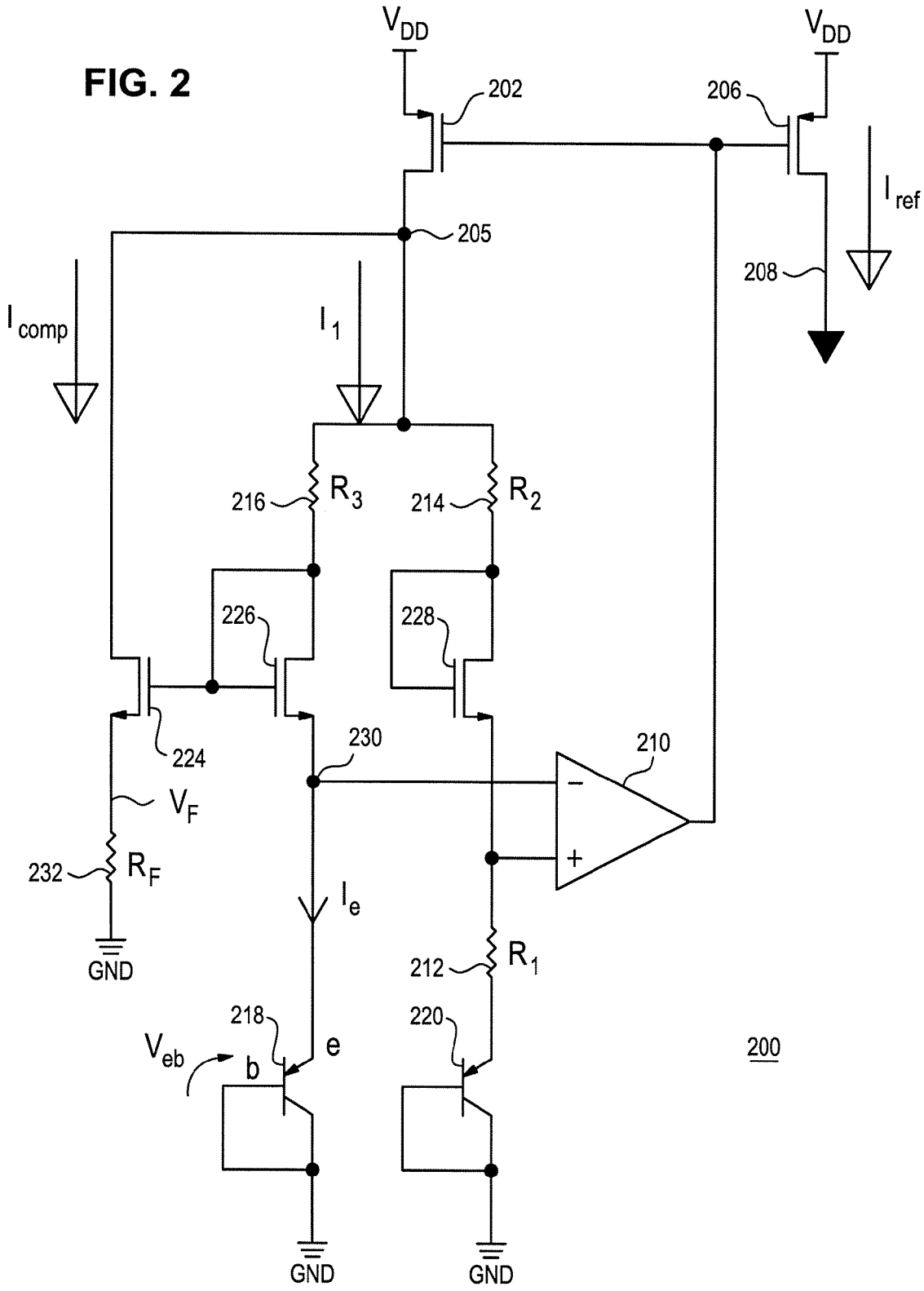
FIG. 2 is a temperature compensated reference current generator circuit for providing a temperature compensated reference current in accordance with the present invention.

FIG. 2 is an illustration of a temperature compensated reference current generator circuit 200 for providing a temperature compensated reference current in accordance with the present invention. Circuit 200 comprises p-type metal-oxide semiconductor (PMOS) transistor 202, PMOS transistor 206, Operational amplifier (OP-AMP) 210, resistors $R_1$ 212, $R_2$ 214, $R_3$ 216, PNP bipolar junction transistor (BJT) 218, PNP BJT 220, n-type metal-oxide semiconductor (NMOS) transistor 224, NMOS transistor 226, NMOS transistor 228, and resistor $R_F$ 232 coupled together as illustrated in FIG. 2. Circuit 200 may be implemented in an integrated circuit or any circuit desiring a consistent reference current source.

The reference current level $I_{ref}$ at node 208 is dependent upon current $I_1$ at node 205, the compensation current $I_{comp}$, and the gain of OP-AMP 210. Current $I_1$ on node 205 is linearly proportional to the absolute temperature (PTAT) of the operating environment for circuit 200. The NMOS transistors 224, 226, and 228 are matched having the same W/L ratios and substantially equal threshold voltage levels. Transistors 224, 226, and 228 may also have similar layout patterns in an integrated circuit and may be in proximity to each other, as desired. Since the threshold voltage of NMOS transistor 224 is substantially similar or equal to NMOS transistor 226, the node voltage $V_F$ of transistor 224 is equal to the emitter-to-base voltage level $V_{eb}$ of PNP BJT transistor 218 giving the following relationship for the compensation current $I_{comp}$:

$$I_{comp}(T) = \frac{V_F(T)}{R_F} = \frac{V_{eb}(T)}{R_F}. \qquad \text{Equation (6)}$$

In Equation (6), $V_{eb}(T)$ is given by Equation (7) as follows:

$$V_{eb}(T) = \frac{k_b T}{q} \ln\left(\frac{I_e(T)}{I_s(T)}\right). \qquad \text{Equation (7)}$$

In Equation (7), $k_b$ is Boltzmann's constant $1.381\times10^{-23}$ Joules per Kelvins (K), T is the absolute temperature in Kelvins, q is the constant electron charge of $1.602\times10^{-19}$ Coulombs, and $I_s(T)$ is the saturation current of transistor 224 given by Equation (3). The emitter current $I_e(T)$ at node 230 is given by Equation (8) as follows:

$$I_e(T) = \frac{I_1}{2} = \frac{k_b T}{q} \ln\left(\frac{M}{R}\right). \qquad \text{Equation (8)}$$

In Equation (8), M is a variable multiplier characteristic of BJT 220 with respect to the size of BJT 218, and R is related to the resistance value of resistors $R_1$ 212, $R_2$ 214, and $R_3$ 216. Substituting Equation (8) and Equation (3) into Equation (7) and taking the first derivative of $V_{eb}(T)$ with respect to temperature gives Equation (9) as follows:

$$\frac{\partial V_{eb}(T)}{\partial T} = \frac{k_b}{q}\left[\ln\left(\frac{\ln(M)}{R}\frac{k_b}{q}\frac{NW}{AqD}\frac{1}{B}\frac{1}{T^2}\right) - 2\right]. \qquad \text{Equation (9)}$$

In Equation (9), A is the area of the device gate, D is the carrier diffusivity, N is the doping concentration, W is the channel width, B is a material dependent parameter, typically $5.4\times10^{31}$ $K^{-3}$ $cm^6$ for silicon, and $E_{gap}$ is the energy gap, typically 1.12 eV for silicon, for NMOS transistor 224. Purely as an example, assuming a predetermined working temperature range of −40° Celsius to 125° Celsius the variation of $$\frac{\partial V_{eb}(T)}{\partial T}$$

is minimal, typically −1/−2 mV/°K., and substantially constant. Equation (9) provides a substantially constant slope and linear function for $V_{eb}(T)$ resulting in a linear relationship to temperature of the compensation current $I_{comp}(T)$ in Equation (6).

Figure 3:
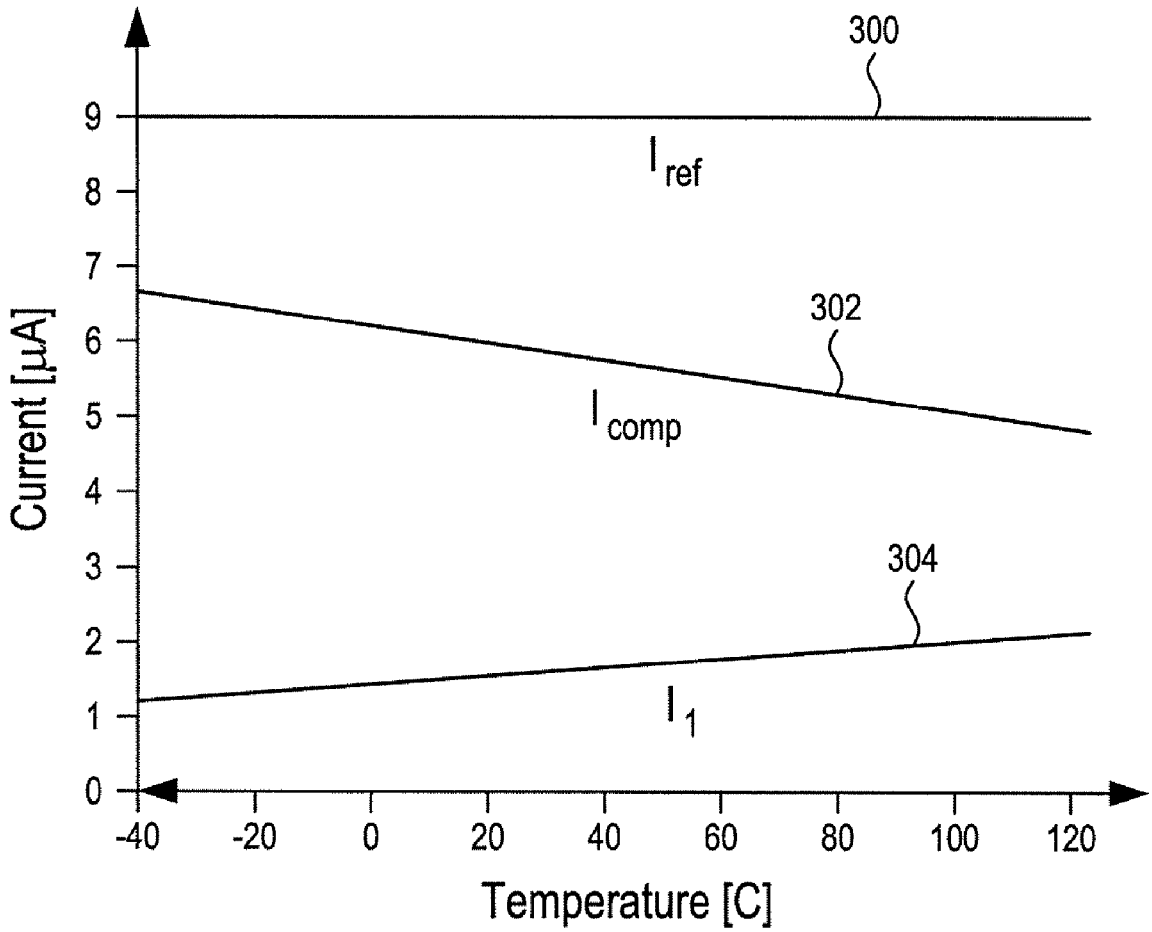
FIG. 3 is an illustration of a temperature compensated reference current provided in accordance with the present invention.

The compensation current $I_{comp}(T)$ can properly negate the effects of the current $I_1(T)$ at node 205 by using an appropriate adjusted value for resistor $R_F$ 232, providing a substantially constant, flat reference current $I_{ref}$ at node 208. As illustrated in FIG. 3, the positive slope of current $I_1$ 304 is substantially compensated by the negative slope of current $I_{comp}$ 302 providing a substantially constant, temperature independent reference current $I_{ref}$ 300 which is substantially flat over a wide temperature operating range and provides at least an order of magnitude performance enhancement over typical reference current generators. Therefore, the linearly increasing temperature dependent current $I_1(T)$ 304 increases at a rate substantially equal to a rate of decrease of the linearly decreasing compensation current $I_{comp}(T)$ 302.

Since $I_{comp}$ is independent of the threshold voltages of NMOS transistors 224, 226, and 228 it is also not directly dependent on circuit fabrication process variations of transistors or other elements in circuit 200. Current $I_{comp}$ is also independent of any supply voltage levels, such as $V_{dd}$. Moreover, the compensation current does not require NMOS transistor 224 to be biased in weak-inversion mode, providing more robust operation and design flexibility of generator circuit 200 since weak-inversion mode depends strongly on process varying parameters.

Figure 4:
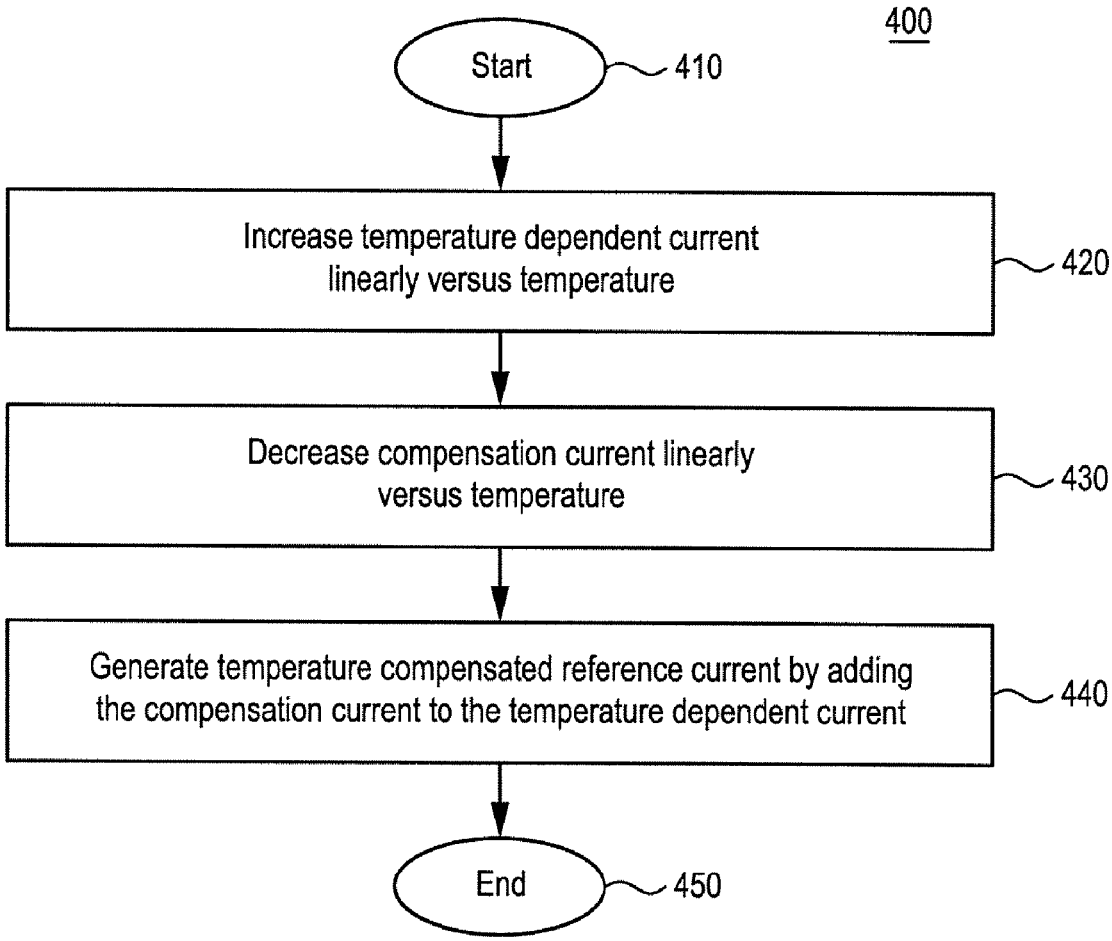
FIG. 4 is an illustration of a process for providing a temperature compensated reference current in accordance with the present invention.

FIG. 4 is an illustration of a process 400, which may be implemented using hardware or software, for providing a temperature compensated reference current comprising steps 410, 420, 430, 440, and 450. In step 420, a temperature dependent current increases linearly versus temperature in a generator circuit. In step 430, a compensation current decreasing linearly versus temperature is provided by the generator circuit. The compensation current is independent of certain circuit process varying parameters, such as threshold voltages. In step 440, a temperature compensated reference current is generated by adding the compensation current to the temperature dependent current. The temperature compensated reference current may be provided by adding a temperature dependent current increasing linearly at a rate substantially equal to a rate of decrease of a linearly decreasing compensation current.

Although the features and elements of the present invention are described in the preferred embodiments in particular combinations, each feature or element can be used alone without the other features and elements of the preferred embodiments or in various combinations with or without other features and elements of the present invention.

What is claimed is:

1. A temperature compensated reference current generator circuit, the circuit comprising:

a first transistor coupled to a node having a linearly increasing temperature dependent current;

a second transistor coupled to the first transistor and the node, the second transistor providing a linearly decreasing compensation current to the node and coupled to a resistor for adjusting the linearly decreasing compensation current;

a substantially constant reference current generated by a third transistor coupled to the first transistor;

wherein the linearly increasing temperature dependent current is added to the linearly decreasing compensation current for providing the substantially constant reference current; and wherein the first transistor is coupled to a fourth transistor and bi-polar junction (BJT) transistor having an emitter-to-base voltage level.

2. The circuit of claim 1, wherein the substantially constant reference current is independent of threshold voltages of the second transistor and the fourth transistor.

3. The circuit of claim 1 wherein the fourth transistor is substantially the same size as the second transistor.

4. The circuit of claim 1 wherein the fourth transistor and the second transistor have substantially equal threshold voltage levels.

5. The circuit of claim 1 wherein the linearly decreasing compensation current is directly proportional to the emitter-to-base voltage level and inversely proportional to the resistance of the resistor.

6. The circuit of claim 5 wherein the derivative of the emitter-to-base voltage level with respect to temperature is substantially constant.

7. The circuit of claim 2 wherein the first and third transistors are p-type metal-oxide semiconductor (PMOS) transistors and second and fourth transistors are n-type metal-oxide semiconductor (NMOS) transistors.

8. The circuit of claim 2 wherein the linearly increasing temperature dependent current increases at a rate substantially equal to a rate of decrease of the linearly decreasing compensation current.

9. The circuit of claim 2 wherein the second transistor is not biased in weak-inversion mode.

10. The circuit of claim 2 wherein the substantially constant reference current generated by the third transistor is substantially constant over a predetermined temperature range.

11. The circuit of claim 10 wherein the predetermined temperature range is −40° Celsius to 125° Celsius.

12. The circuit of claim 2 wherein the linearly decreasing compensation current is independent of threshold voltages of the second and fourth transistor.

13. The circuit of claim 2 wherein the linearly decreasing compensation current is independent of supply voltage levels.

14. The circuit of claim 2 wherein the substantially constant reference current is provided to a memory device, wherein the memory device is any one of a parallel Electrically Erasable Programmable Read-Only Memory (EEPROM) device, a serial EEPROM device, a Flash memory device, a serial Flash memory device, and a stacked Flash and Random Access Memory (RAM) memory device.

15. The circuit of claim 1 wherein the substantially constant reference current is substantially constant up to about 125° Celsius.

16. A method for providing a temperature compensated reference current, the method comprising:

providing a linearly increasing temperature dependent current;

providing a linearly decreasing compensation current;

generating a substantially constant reference current by adding the linearly increasing temperature dependent current to the linearly decreasing compensation current;

providing the substantially constant reference current to a memory device;

wherein the linearly increasing temperature dependent current increases at a rate substantially equal to a rate of decrease of the linearly decreasing compensation current; and wherein providing a linearly decreasing compensation current includes basing the linearly decreasing compensation current on an emitter-to-base voltage level of a bi-polar junction transistor.

17. The method of claim 16 wherein the substantially constant reference current is independent of supply voltage levels.

18. The method of claim 16 wherein the substantially constant reference current is constant over a predetermined temperature range.

19. The method of claim 18 wherein the predetermined temperature range is −40° Celsius to 125° Celsius.

20. The method of claim 16 wherein providing the substantially constant reference current includes providing the substantially constant reference current to any one of a parallel Electrically Erasable Programmable Read-Only Memory (EEPROM) device, a serial EEPROM device, a Flash memory device, a serial Flash memory device, and a stacked Flash and Random Access Memory (RAM) memory device.

21. The method of claim 16, wherein providing a linearly decreasing compensation current includes basing the linearly decreasing compensation current inversely on a resistance value.

22. An integrated circuit having a temperature compensated reference current generator circuit, the temperature compensated reference current generator circuit comprising:

a first transistor coupled to a node having a linearly increasing temperature dependent current;

a second transistor coupled to the first transistor and the node, the second transistor providing a linearly decreasing compensation current to the node and coupled to a resistor for adjusting the linearly decreasing compensation current;

a substantially constant reference current generated by a third transistor coupled to the first transistor;

wherein the linearly increasing temperature dependent current is added to the linearly decreasing compensation current negating the effect of the temperature dependent current for providing the substantially constant reference current; and wherein the first transistor is coupled to a fourth transistor and a bi-polar junction transistor having an emitter-to-base voltage level.

23. The integrated circuit of claim 22, wherein the substantially constant reference current is input to a non-volatile memory.

24. The integrated circuit of claim 22, wherein the substantially constant reference current is independent of threshold voltages of the second transistor and the fourth transistor.

* * * * *

UNITED STATES PATENT AND TRADEMARK OFFICE

CERTIFICATE OF CORRECTION

PATENT NO. : 7,456,678 B2
APPLICATION NO. : 11/548113
DATED : November 25, 2008
INVENTOR(S) : Passerini et al.

It is certified that error appears in the above-identified patent and that said Letters Patent is hereby corrected as shown below:

In column 6, line 8, in Claim 1, delete “and” and insert -- and a --, therefor.

In column 6, line 26, in Claim 7, delete “claim 2” and insert -- claim 1 --, therefor.

In column 6, line 30, in Claim 8, delete “claim 2” and insert -- claim 1 --, therefor.

In column 6, line 34, in Claim 9, delete “claim 2” and insert -- claim 1 --, therefor.

In column 6, line 36, in Claim 10, delete “claim 2” and insert -- claim 1 --, therefor.

In column 6, line 42, in Claim 12, delete “claim 2” and insert -- claim 1 --, therefor.

In column 6, line 45, in Claim 13, delete “claim 2” and insert -- claim 1 --, therefor.

In column 6, line 47, in Claim 14, delete “claim 2” and insert -- claim 1 --, therefor.

Signed and Sealed this

Twenty-fourth Day of February, 2009

John Doll

JOHN DOLL
*Acting Director of the United States Patent and Trademark Office*